US009988239B2

(12) United States Patent
Toutaoui

(10) Patent No.: US 9,988,239 B2
(45) Date of Patent: Jun. 5, 2018

(54) PREVENTATIVE MAINTENANCE BY DETECTING NUMBER OF SWITCHING EVENTS OF COMPONENTS

(71) Applicant: OTIS ELEVATOR COMPANY, Farmington, CT (US)

(72) Inventor: Mustapha Toutaoui, Berlin (DE)

(73) Assignee: OTIS ELEVATOR COMPANY, Farmington, CT (US)

( * ) Notice: Subject to any disclaimer, the term of this patent is extended or adjusted under 35 U.S.C. 154(b) by 289 days.

(21) Appl. No.: 14/779,041

(22) PCT Filed: Mar. 22, 2013

(86) PCT No.: PCT/US2013/033476
§ 371 (c)(1),
(2) Date: Sep. 22, 2015

(87) PCT Pub. No.: WO2014/149054
PCT Pub. Date: Sep. 25, 2014

(65) Prior Publication Data
US 2016/0052747 A1 Feb. 25, 2016

(51) Int. Cl.
*B66B 1/34* (2006.01)
*B66B 5/00* (2006.01)
*B66B 29/00* (2006.01)

(52) U.S. Cl.
CPC ..... *B66B 5/0025* (2013.01); *B66B 29/00* (2013.01)

(58) Field of Classification Search
CPC ..... B66B 5/0025; B66B 29/00
USPC ..... 187/247, 277, 391, 393
See application file for complete search history.

(56) References Cited

U.S. PATENT DOCUMENTS 3,973,648 A * 8/1976 Hummert ..... B66B 5/0006 187/393
4,418,795 A * 12/1983 Trosky ..... B66B 5/0006 187/391
4,512,442 A 4/1985 Moore et al.
4,698,780 A * 10/1987 Mandel ..... B66B 5/0006 187/393

(Continued)

FOREIGN PATENT DOCUMENTS

CN 1111594 A 11/1995
CN 1855691 A 11/2006

(Continued)

OTHER PUBLICATIONS

Chinese Office Action for application CN 2013800769766.1, dated Jan. 11, 2017, 11 pgs.

(Continued)

*Primary Examiner* — Anthony Salata
(74) *Attorney, Agent, or Firm* — Cantor Colburn LLP

(57) ABSTRACT

A system for providing preventative maintenance of switchable components includes a load-moving system including one or more switchable components. The system also includes a microcontroller configured to operate the one or more switchable components of the load-moving system, to determine a number of switching events of the one or more switchable components and to perform a preventative maintenance action based on determining that the number of switching events is greater than a threshold number of switching events.

21 Claims, 3 Drawing Sheets

(56) References Cited

U.S. PATENT DOCUMENTS

| | | | | |
|---|---|---|---|---|
| 4,750,591 | A * | 6/1988 | Coste | B66B 5/0006 187/391 |
| 5,107,964 | A * | 4/1992 | Coste | B66B 13/22 187/280 |
| 5,420,571 | A | 5/1995 | Coleman et al. | |
| 5,476,157 | A * | 12/1995 | Todaro | B66B 13/24 187/280 |
| 6,330,935 | B1 * | 12/2001 | Systermans | B66B 5/0025 187/391 |
| 6,330,936 | B1 * | 12/2001 | Lence Barreiro | B66B 5/0025 187/247 |
| 6,543,583 | B1 * | 4/2003 | Lence Barreiro | B66B 5/0025 187/316 |
| 6,604,611 | B2 * | 8/2003 | Liu | B66B 5/0025 187/247 |
| 7,966,537 | B2 | 6/2011 | Bonaccio et al. | |
| 8,689,944 | B2 * | 4/2014 | Manfredi | B66B 1/30 187/289 |
| 8,820,482 | B2 * | 9/2014 | De Coi | B66B 5/0031 187/247 |
| 9,580,276 | B2 * | 2/2017 | Toutaoui | B66B 1/3461 |
| 2012/0029839 | A1 | 2/2012 | Ritter et al. | |
| 2014/0027209 | A1 * | 1/2014 | Kallioniemi | B66B 5/0025 187/391 |

FOREIGN PATENT DOCUMENTS

| | | | |
|---|---|---|---|
| CN | 102173208 | A | 9/2011 |
| CN | 102556782 | A | 7/2012 |
| JP | 10255992 | A | 9/1998 |
| JP | 2001089045 | A | 4/2001 |
| JP | 2002179349 | A | 6/2002 |
| JP | 2009202992 | A | 9/2009 |
| WO | 9608437 | A1 | 3/1996 |
| WO | 2006106174 | A1 | 10/2006 |

OTHER PUBLICATIONS

International Search Report for application PCT/US2013/033476, dated Dec. 26, 2013, 5 pages.
Written Opinion for application PCT/US2013/033476, dated Dec. 26, 2013, 7 pages.
European Search Report for application EP 163878878.1, dated Oct. 24, 2016, 8 pages.
Chinese Office Action Decision on Rejection for application CN 201380076766.1, dated Dec. 1, 2017, 9 pages.

* cited by examiner

PREVENTATIVE MAINTENANCE BY DETECTING NUMBER OF SWITCHING EVENTS OF COMPONENTS

BACKGROUND OF THE INVENTION

Embodiments of the invention relate to providing preventative maintenance and, in particular, to detecting the lifetime of switchable components of a load-moving structure.

Load-moving structures, including elevators and escalators, include moving components for moving loads across distances, as well as electrical and electronic components to supply power to motors, lights and other systems of the load-moving structures. Currently most components of elevators, escalators or other load-moving structures are replaced when they are defective. Waiting until a component fails before replacing the component may result in damage to circuitry or other systems around the component and result in unscheduled, and potentially inconvenient, shutdown times.

BRIEF DESCRIPTION OF THE INVENTION

Embodiments of the present invention include a system for providing preventative maintenance of switchable components. The system includes a load-moving structure including one or more switchable components. The system also includes a microcontroller configured to operate the one or more switchable components of the load-moving system, to determine a usage value including determining a number of switching events of the one or more switchable components and to perform a preventative maintenance action based on determining that the usage value is greater than a threshold value.

Embodiments of the invention further include a method including monitoring, by a microcontroller of a load-moving system, switching events of one or more switchable components of the load-moving structure. The switchable components are configured to monitor or control operations of the load-moving structure. The method includes determining, by the microcontroller, whether a usage value including a number of switching events of the one or more switchable components is greater than a predetermined threshold. The method also includes performing, by the microcontroller, a preventative maintenance action based on determining that the usage value is greater than the predetermined threshold.

BRIEF DESCRIPTION OF THE DRAWINGS

The subject matter which is regarded as the invention is particularly pointed out and distinctly claimed in the claims at the conclusion of the specification. The foregoing and other features, and advantages of the invention are apparent from the following detailed description taken in conjunction with the accompanying drawings in which:

DETAILED DESCRIPTION OF THE INVENTION

Conventional load-moving structures include electrical and electronic components that break down after being used over a typical lifetime of the components, requiring unscheduled stoppage of the elevating structure.

Figure 1:
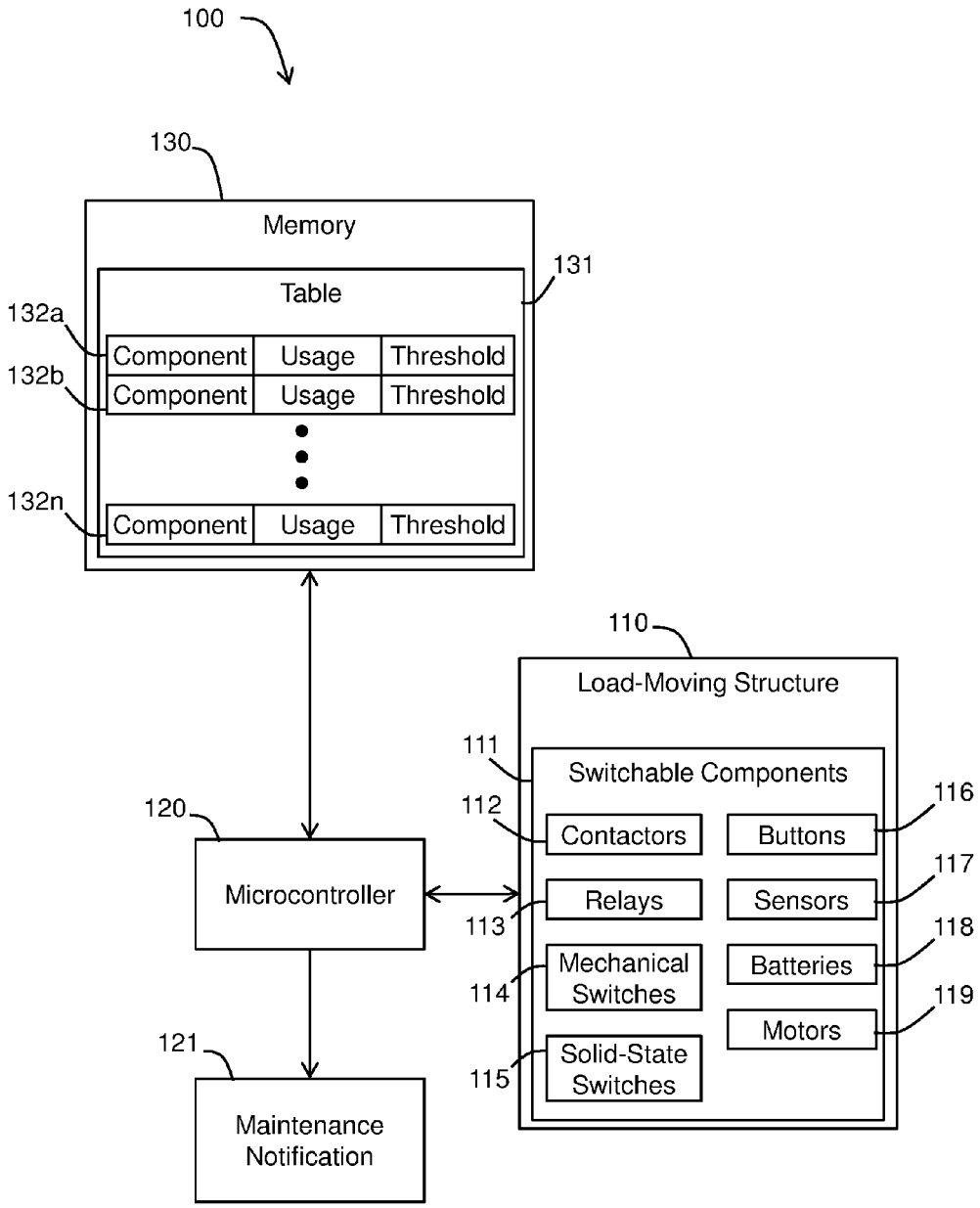
FIG. 1 illustrates according to one embodiment of the invention.

FIG. 1 illustrates a system 100 according to an embodiment of the invention. The system 100 includes a load-moving structure 110, a microcontroller 120 to monitor and control operation of the load-moving structure 110 and memory 130 that is accessed by the microcontroller 120. Alternatively, the memory 130 may be part of the microcontroller 120. The memory 130 may be solid-state memory, such as flash memory, or any other type of data storage. The load-moving structure 110 may be, for example, an elevator, elevator system, escalator or any other structure that is fixed with respect to the ground or another reference plane. The load-moving structure 110 may have belts, cables, ropes, gears or other apparatuses for moving a load from one location to another.

The load-moving structure 100 includes one or more switchable components 111. In the present specification and claims, a switchable component is a component that may be controlled to perform a switching operation and a component that may be switched in a switching operation. For example, both a switch and a battery may be a switchable component, since the switch may be controlled to pass current or block current flow, and the battery may be switched from a power-providing state to a non-power-providing state. Switchable components that may be controlled to perform a switching operation are referred to in the specification and claims as switches or switching components, while switchable components that are themselves switched between one state and another, but that do not perform a switching operation, are referred to as switched components. Examples of switches or switching components include analogs switches, relays and solid-state switches. Examples of switched components include sensors that output different sensor signals based on sensed characteristics and batteries that selectively output power based on the needs of a system.

In FIG. 1, the load-moving structure includes one or more contactors 112, relays 113, other mechanical switches 114, solid-state switches 115, buttons 116, sensors 117, batteries 118 and motors 119. For example, in an embodiment in which the load-moving structure 110 is an elevator, the contactors 112 and relays 113 may control one or more motors 119 for moving an elevator car and moving doors of the elevator car. Mechanical switches 114 and solid-state switches 115 may monitor a position of the doors of the elevator car and control power supplied to one or more components of the elevator car, including lighting, fans, climate control elements, automated doors, etc. Buttons 116 may be pressed by users of the elevator car to select destinations or other features, controlling power supplied to the microcontroller 120, to lights within the buttons 116 or any other power destination. Sensors 117 may be turned on to monitor all aspects of operation of the elevator car, including door operation, lighting, climate control, electronics systems and elevator car position. Batteries 118 may be tapped to provide power during power line outages or shortages and bypassed when full power is supplied from a power line.

In embodiments of the invention, the switchable components 111 may be part of the operating systems of the load-moving structure 110 to monitor or control the load-moving structure 110. In an example in which the load-moving structure 110 is an elevator, the switchable components 111 may be part of a drive system, a safety system a car control system, a car monitoring system, a lighting system, or any other auxiliary system. For example, the drive system may include relays 113 to turn on and off a motor 119, a motor 119 that is turned on and off, sensors 117 to detect current flow, elevator car speed, a load of an elevator car and mechanical and solid-state switches 114 and 15 to control power levels of the drive system.

The safety system may include sensors 117 and mechanical switches 114 to detect a position of elevator car doors and sensors 117 to detect a location of the elevator car within an elevator shaft, lighting, temperature or speed of the elevator car. The safety system may also include mechanical switches 114 or solid-state switches 115 to shut off power to a drive system or to prevent opening or closing of the car doors when a safety condition is detected. The safety system may also include batteries 118 that may be un-tapped when power is provided to the elevator system via an electric line and may be activated when power interruptions occur.

The car monitoring system and lighting system may include sensors 117 to detect light, temperature, load, position and any other characteristics of an elevator car. The car monitoring system and lighting system may also include mechanical and solid-state switches 114 and 115 to adjust power to climate control systems or lighting systems or to transmit signals to a drive system or microcontroller 120 that controls operation of the elevator car system.

In embodiments of the invention, the switchable components 111 are part of the operating systems of the load-moving structure 110. Sensors 117 are used to provide information about operation of the load-moving structure 110, and the information is used to control the load-moving structure 110, such as by adjusting mechanical and electrical characteristics of the load-moving structure 110. Mechanical and solid-state switches 114 and 115 are used to control power flow to components of the structure 110, motors 119 are used to control movement of the structure 110, and batteries are used to supply power to the structure 110.

The microcontroller 120 controls operations of the load-moving structure 110 and monitors changes in the state of the switchable components 111 during operation of the load-moving structure 110 as the components 111 monitor and control the operation of the load-moving structure 110. The microcontroller 120 detects when the number of switching events of a switchable component 111 corresponds to a life-expectancy of the component 111 and generates a maintenance notification 121, such as a signal or message, indicating that, even though the component 111 has not failed, preventative maintenance of the component 111 may be performed, since the component 111 is at its life expectancy or within a predetermined range of switching events of its life expectancy. Accordingly, unscheduled interruptions to operation of the load-moving structure 110 may be avoided.

The microcontroller 120 detects the number of switching events by detecting commands to perform a switching operation, in the case of actively controlled switching components, such as contactors 112, relays 113, mechanical switches 114 and solid-state switches 115, and incrementing a counter in a table 131 stored in memory 130 accordingly. In the case of switched components such as buttons 116, sensors 117 and batteries 118 which change states based on non-control-signal criteria, such as a user button press, characteristic detection in the case of sensors, or a closing of a circuit in the case of batteries 118, the microcontroller 120 detects the change in state of the switchable components 111 from a first state associated with a first power level to a second state associated with a second power level. For example, when a user presses a button 116 to select a floor in an elevator, the microcontroller 120 detects the input signal or current flow caused by the button press and increments a counter associated with the button accordingly.

The table 131 includes entries 132*a*, 132*b* to 132*n* associated with each switchable component 111 that is monitored to provide preventative maintenance. The entries include a component identifier, a value corresponding to the actual usage of the component and a threshold value corresponding to an expected life of the component. In embodiments of the invention, the "usage" value includes a counter value corresponding to a number of switching events associated with the component. The counter value is provided by the microcontroller 120 that operates the switchable components 111 or monitors the status of the switchable components 111 in the case of the buttons 116, sensors 117, batteries 118 and motors 119.

The usage value or the threshold value may include, in addition to values corresponding to a number of switching events, algorithms to take into account additional factors that affect the life expectancy of a component. For example, the threshold information may take into account a power state of the switchable component 111. In one embodiment, a sensor 117 may have a shorter life expectancy if it is in an "on" state and outputting a sensor signal than when it is in an "off" state and not outputting the sensor signal. Accordingly, the counter may include a count number as well as time information to record how long the sensor 117 was turned on. The threshold information may account for both a number of switch events of the sensor 117 as well as the duration of an "on" state or "off" state. The combined switching information and power state information may be used by the microcontroller 120 to determine whether the sensor 117 has exceeded its life expectancy or come within a predetermined time period of its life expectancy.

The usage value or threshold value may also be based on additional factors, such as an environment in which the load-moving structure 110 is located, traffic and power levels supported by the switchable components 111. Examples of environmental factors that may affect the life expectancy include the temperature or the humidity in which the load-moving structure 110 operates. Examples of traffic include a number of switching events per hour, per day or per month that occur. Examples of power levels that may affect the life expectancy of a component 111 include power spikes, high-power environments, short circuits, etc.

The threshold against which the usage value of a switchable component 111 is compared may be increased or decreased from a base threshold according to any of these factors or additional factors. The base threshold value may be obtained from the device specifications provided from a manufacturer, from prior testing or by any other means of determining an average or benchmark threshold value of a life span of a component. In one embodiment, the usage value and the threshold are counter values, and the value of the threshold is adjusted upward or downward based on the operating and environmental factors discussed above. For example, if the microcontroller 120 detects ten power surges in the load-moving structure 110, and if it is known based on statistical data, test data or specification data that each power surge effectively reduces the life of a switchable component 111 by one hundred switching events, then the threshold value for that component may be reduced by one thousand. Accordingly, the microcontroller 120 will detect an end-of-life of the switchable component 111 sooner than if no power surges had occurred.

When the microcontroller 120 determines that a usage value of a switchable component 111 has exceeded the threshold switch count, the microcontroller 120 performs a preventative maintenance action, such as generating a maintenance notification 121. A maintenance notification 121 may be a text-based message, indicator light, sound, or other tactile signal, or any other method of notifying a user or system that maintenance may be required on a particular switchable component 111. In another embodiment, instead of being a counter value, the usage value is a composite value that includes the counter value as well as additions to, or subtractions from, the counter value based on operating factors and environmental factors. In one embodiment, the microcontroller 120 generates a maintenance notification 121 that indicates suggested maintenance but does not indicate a switching count.

Figure 2:
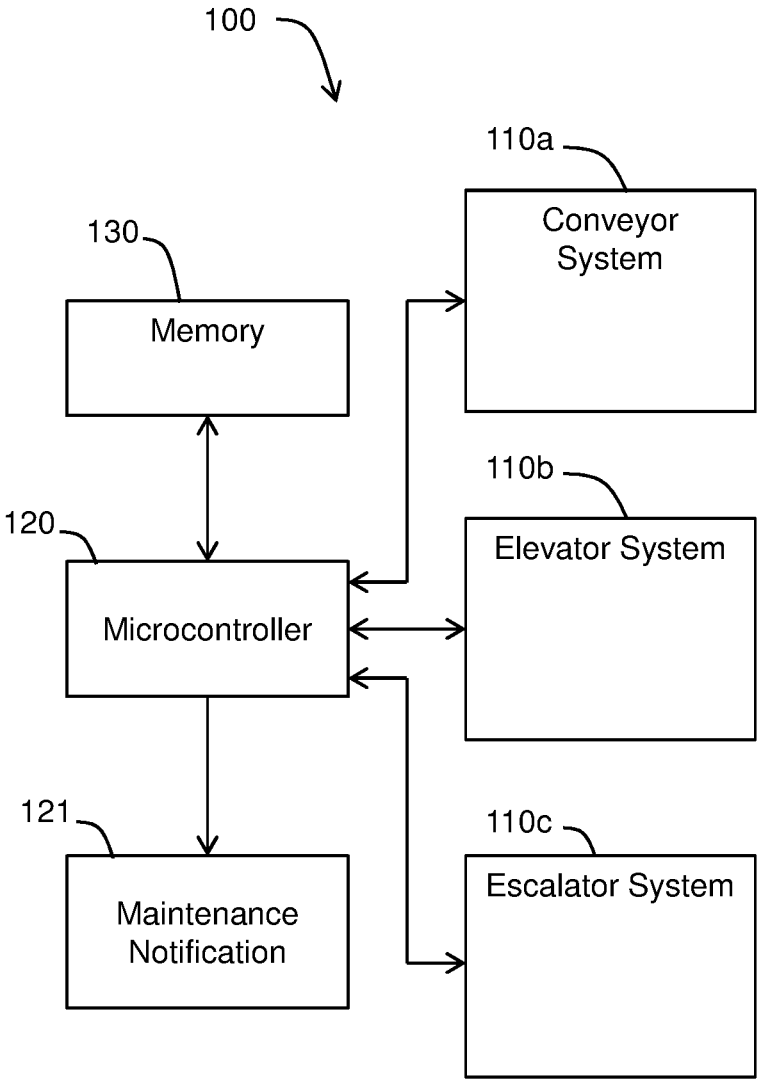
FIG. 2 illustrates according to another embodiment of the invention.

While an elevator system has been used to describe one embodiment of the invention, embodiments encompass any load-moving structure 110. FIG. 2 illustrates a system 100 in which the load-moving structure 110 includes a conveyor system 110*a*, an elevator system 110*b* and an escalator system 110*c*. However, these systems are provided only by way of example, and embodiments of the invention encompass any load-moving structure 110.

Figure 3:
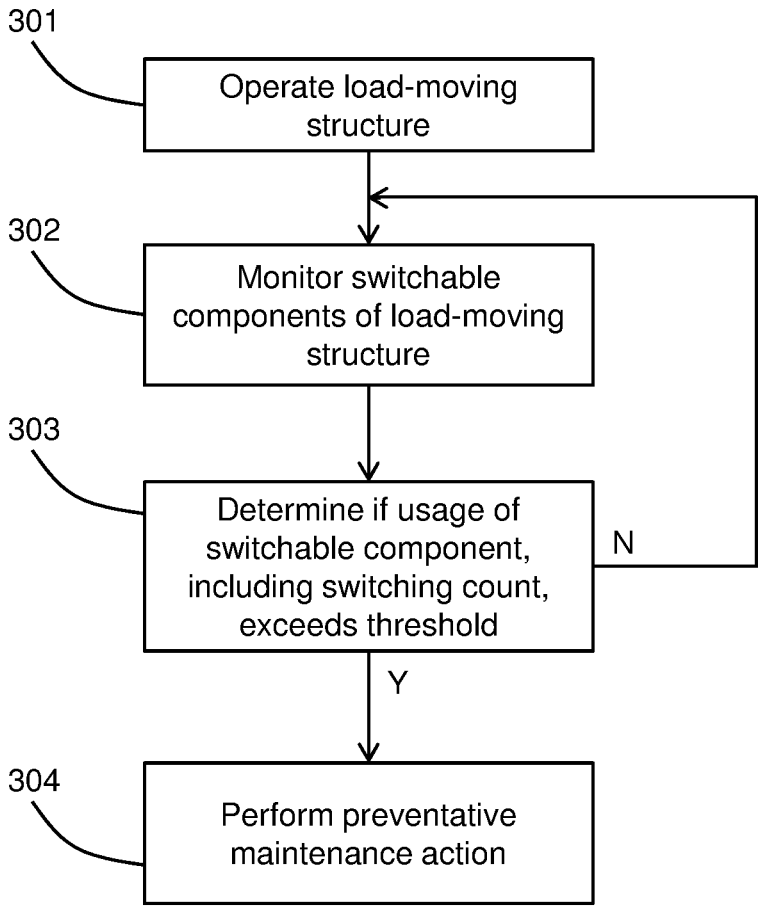
FIG. 3 is a flow diagram of a method according to an embodiment of the invention.

FIG. 3 is a flow chart illustrating a method according to an embodiment of the invention. In block 301, a load-moving structure is operated. For example, an elevator may be run up and down an elevator shaft, an escalator may be run, a conveyor may be run or any other load-moving structure may be run. Running the load-moving structure may include controlling one or more switches to direct current through circuitry of the load-moving structure. Running the load-moving structure may also include monitoring one or more switched components to determine whether the switched component is causing current to flow into, or out of, the electrical circuit of the load-moving structure.

In bock 302, the switchable components of the load-moving structure are monitored to determine a number of switching events of each switchable component. For example, a microcontroller may be used to control the load-moving structure. The microcontroller may monitor a number of turn on and turn off commands to switch components and a number of times that switched components are activated and deactivated.

In block 303, it may be determined if the usage of the switchable component, including the switching count, exceeds a threshold value. In some embodiments one or both of the usage value and the threshold value includes factors in addition to a switching count, such as operating temperatures, humidity, power levels, power states, durations at a power state, and any other factor that may alter a life expectancy of a device.

If the usage of the switchable component is below the threshold, the monitoring of the switchable component continues. However, if the usage of the switchable component is equal to or exceeds the threshold, then a preventative maintenance action is performed in block 304. Examples of preventative maintenance actions include generating signals or notices that a switchable component has reached, or is near, the end of its expected life and should be replaced. In some embodiments, the notice identifies the component may name or identifier and location within the load-moving structure.

According to embodiments of the invention, a microcontroller monitors switchable components that are used to operate a load-moving structure and generates a preventative notification based on a switching-event count of the switchable components. Accordingly, components of an elevator, escalator, conveyor or other load-moving structure may be replaced at a scheduled time prior to failure of the component, preventing potential damage to other components due to failure of the component and preventing an unscheduled shut-down of the load-moving structure. In addition, embodiments of the invention do not require specially-designed switches or switchable devices. Instead, the microcontroller that controls the switching of the switchable devices also tracks the switching to determine whether a preventative maintenance action should be performed.

While the invention has been described in detail in connection with only a limited number of embodiments, it should be readily understood that the invention is not limited to such disclosed embodiments. Rather, the invention can be modified to incorporate any number of variations, alterations, substitutions or equivalent arrangements not heretofore described, but which are commensurate with the spirit and scope of the invention. Additionally, while various embodiments of the invention have been described, it is to be understood that aspects of the invention may include only some of the described embodiments. Accordingly, the invention is not to be seen as limited by the foregoing description, but is only limited by the scope of the appended claims.

The invention claimed is:

1. A system for providing preventative maintenance of switchable components, comprising:

a load-moving structure including one or more switchable components; and a microcontroller configured to operate the one or more switchable components of the load-moving structure, to determine a usage value including determining a number of switching events of the one or more switchable components and to perform a preventative maintenance action based on determining that the usage value is greater than a threshold value;

wherein the usage value and the threshold value further include, in addition to values corresponding to a number of switching events, algorithms to take into account additional factors that affect life expectancy of the one or more switchable components.

2. The system of claim 1, wherein the load-moving structure is one of an elevator and an escalator.

3. The system of claim 1, wherein the threshold value is a number corresponding to an expected number of switching events over a lifetime of the one or more switchable components.

4. The system of claim 1, wherein the one or more switchable components includes at least one mechanically-activated switch, and determining the number of switching events includes determining a number of times that the at least one mechanically-activated switch is switched between a first power state corresponding to a first power level flowing through the at least one mechanically-activated switch and a second power state corresponding to a second power level flowing through the at least one mechanically-activated switch, the first power level being greater than the second power level.

5. The system of claim 4, wherein the at least one mechanically-driven switch includes at least one of a switch in an elevator safety chain, a door zone detection switch of the elevator and a braking switch for brakes of the elevator.

6. The system of claim 1, wherein the one or more switchable components includes at least one solid-state switch, and determining the number of switching events includes determining a number of times that the at least one solid-state switch is switched between a first power state corresponding to a first power level flowing through the at least one solid-state switch and a second power state corresponding to a second power level flowing through the at least one solid-state switch, the first power level being greater than the second power level.

7. The system of claim 6, wherein determining the number of switching events includes determining a number of times that a switching command is sent to a solid-state switch.

8. The system of claim 1, wherein the one or more switchable components includes a sensor, and determining the number of switching events includes determining a number of times that the sensor is activated.

9. The system of claim 1, wherein the switching event includes detecting when the switchable component is switched from a first power state associated with a first power level to a second power state corresponding to a second power level different from the first power level.

10. The system of claim 1, further comprising:

memory having stored therein a list of the one or more switchable components and counters corresponding to the number of switching events of the one or more switchable components.

11. The system of claim 1, wherein the preventative maintenance action includes generating a notice that the one or more switchable components should be replaced.

12. The system of claim 1, wherein the threshold value is based on a base value corresponding to a type of the switchable component and an adjustment corresponding to environmental conditions in which the switchable component operates.

13. A method comprising:

monitoring, by a microcontroller of a load-moving system, switching events of one or more switchable components of the load-moving structure, the switchable components configured to monitor or control operations of the load-moving structure;

determining, by the microcontroller, whether a usage value including a number of switching events of the one or more switchable components is greater than a predetermined threshold; and performing, by the microcontroller, a preventative maintenance action based on determining that the usage value is greater than the predetermined threshold;

wherein the usage value and the threshold value further include, in addition to values corresponding to a number of switching events, algorithms to take into account additional factors that affect life expectancy of the one or more switchable components.

14. The method of claim 13, wherein the load-moving structure is one of an elevator and an escalator.

15. The method of claim 13, wherein the predetermined threshold corresponds to a number of switching events expected over a lifetime of the one or more switchable components.

16. The method of claim 13, wherein the preventative maintenance action includes generating a notice that preventative maintenance may be required for the one or more switchable components.

17. The method of claim 13, wherein the one or more switchable components includes at least one mechanically-activated switch, and determining whether the usage value is greater than the predetermined threshold includes determining a number of times that the at least one mechanically-activated switch is switched between a first power state corresponding to a first power level flowing through the at least one mechanically-activated switch and a second power state corresponding to a second power level flowing through the at least one mechanically-activated switch, the first power level being greater than the second power level.

18. The method of claim 17, wherein the at least one mechanically-driven switch includes at least one of a switch in an elevator safety chain, a door zone detection switch of the elevator and a braking switch for brakes of the elevator.

19. The method of claim 13, wherein the one or more switchable components includes at least one solid-state switch, and determining whether the usage value is greater than the predetermined threshold includes determining a number of times that the at least one solid-state switch is switched between a first power state corresponding to a first power level flowing through the at least one solid-state switch and a second power state corresponding to a second power level flowing through the at least one solid-state switch, the first power level being greater than the second power level.

20. The method of claim 19, wherein determining whether the usage value is greater than the predetermined threshold includes determining whether a number of switching commands issued to the at least one solid-state switch is greater than the predetermined threshold.

21. The method of claim 13, wherein the one or more switchable components includes a sensor, and determining whether the usage value is greater than the predetermined threshold includes determining a number of times that the sensor is activated.

* * * * *